United States Patent [19]

Gallery et al.

[11] Patent Number: 4,823,823

[45] Date of Patent: Apr. 25, 1989

[54] SELF-RAISING CANOPY FOR MERCHANDISING CART

[76] Inventors: Stanley A. Gallery, 11745 W. 66th Pl., Arvada, Colo. 80004; Daniel J. Gallery, 11600 Shoshone, Westminster, Colo. 80234

[21] Appl. No.: 184,620

[22] Filed: Apr. 22, 1988

[51] Int. Cl.[4] ..... E04H 15/02

[52] U.S. Cl. ..... 135/96; 296/163; 160/45

[58] Field of Search ..... 135/96, 102, 101, 16; 296/163; 160/45

[56] References Cited

U.S. PATENT DOCUMENTS

| | | | |
|---|---|---|---|
| 2,976,078 | 3/1961 | Maidl | 296/163 X |
| 3,356,126 | 12/1967 | Schantz | 160/62 |
| 3,606,445 | 9/1971 | Wunderlich | 135/16 |
| 3,918,510 | 11/1975 | Hayward | 160/45 |
| 4,010,973 | 3/1977 | Heinrich | 296/163 X |
| 4,184,295 | 1/1980 | Hicks | 52/64 |
| 4,648,573 | 3/1987 | Rubnerth | 160/45 X |

*Primary Examiner*—J. Karl Bell
*Attorney, Agent, or Firm*—Klaas & Law

[57] ABSTRACT

A movable cart for merchandising products wherein a canopy is supported on an upper surface of the body portion of the cart so that it may be raised or lowered relative to the upper surface wherein upwardly extending supports are mounted on four corners of the upper surface and downwardly extending supports are pivotally connected to a frame on which the canopy is mounted and the upwardly and downwardly extending supports are connected together to provide relative sliding movement therebetween and a gas spring is mounted within the upwardly and downwardly extending supports to urge the downwardly extending supports and therefore the canopy away from the upper surface, and locking apparatus is provided to hold the upper and lower supports in a relatively fixed relationship so that the canopy will be maintained at a desired distance above the upper surface.

20 Claims, 1 Drawing Sheet

FIG. 1
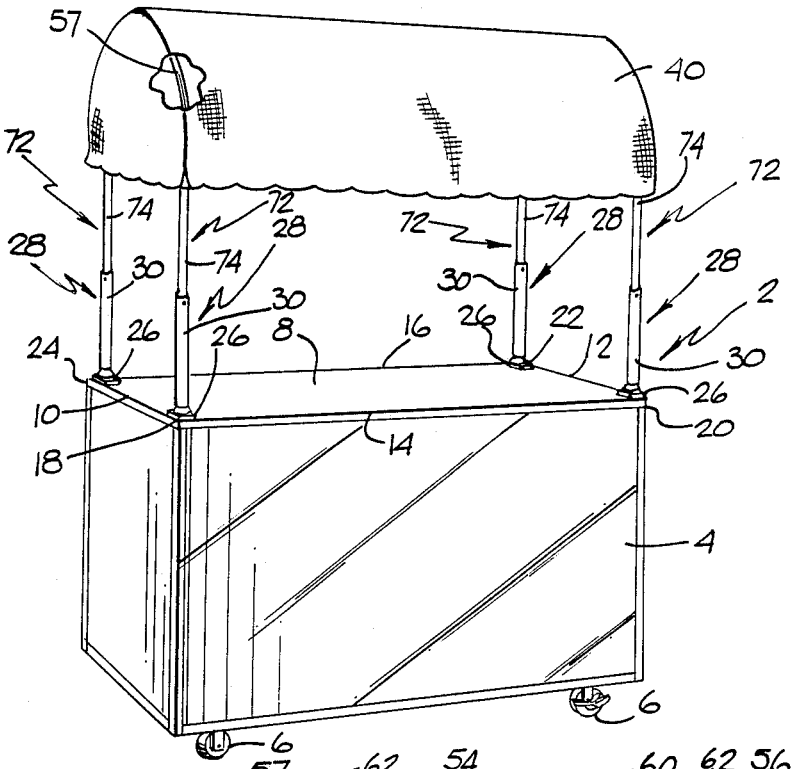
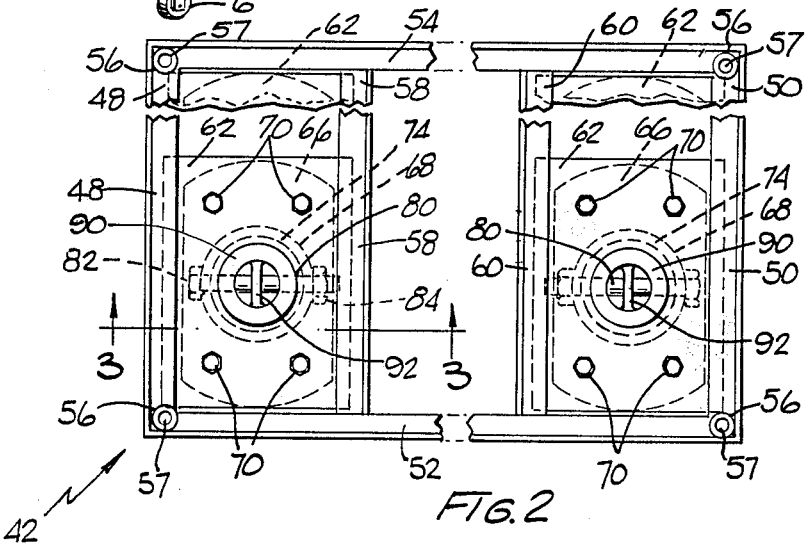
FIG. 2
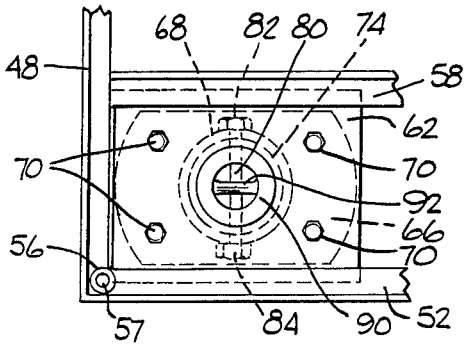
FIG. 4
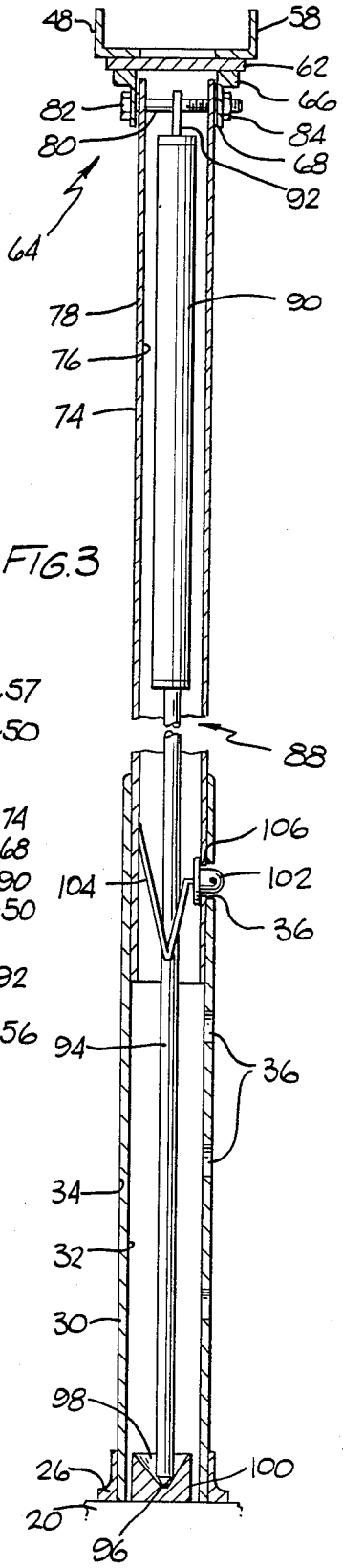
FIG. 3

SELF-RAISING CANOPY FOR MERCHANDISING CART

FIELD OF THE INVENTION

This invention relates generally to a canopy for use with a movable merchandising cart and more particularly to a canopy which may be raised or lowered in relation to an upper surface of the body portion of the cart.

BACKGROUND OF THE INVENTION

In many instances, it is desirable to provide a movable merchandising cart with a canopy to add attractive and identifying characteristics to the movable merchandising cart. Therefore, it is desirable to locate the canopy at a relatively high position above the upper surface of the body portion of the cart. This presents problems when it is necessary to move the cart through an opening having a restricted height such as a doorway to a building or an elevator in a building. To overcome this problem, many movable merchandising carts are provided with means for raising or lowering the canopy relative to the upper surface of the body portion of the movable merchandising cart. While the overall problem has been solved by such raising and lowering means, there still exist problems in readily and easily accomplishing this raising and lowering of the canopy.

BRIEF DESCRIPTION OF THE INVENTION

This invention provides apparatus for raising and lowering a canopy relative to an upper surface of the body portion of a cart wherein relatively movable support means support the canopy on the upper surface and are pivotally connected to the canopy and wherein self-raising means are provided for urging the movable portion of the support means and therefore the canopy in a direction away from the upper surface of the body portion of the cart.

In a preferred embodiment of the invention, there is provided a movable merchandising cart having a body portion having an upper surface having at least two relatively short linearly extending sides substantially parallel to each other and at least two relatively long linearly extending sides substantially parallel to each other and at least four corner locations. Upwardly extending support means, each of which comprises a hollow elongated body having an internal cross-sectional configuration, are mounted on the upper surface at each of the four corner locations. A canopy for the cart is mounted on a frame means having at least four corners and downwardly extending support members are pivotally mounted on the frame means and each of the downwardly extending support members comprises a hollow elongated member having an external configuration permitting the hollow elongated member to be inserted into the hollow elongated body so as to provide for relative sliding movement therebetween. Each pivotal mounting of the hollow elongated member has a longitudinal axis extending substantially parallel to the relatively long sides. A gas spring is pivotally mounted within the hollow elongated member and has a portion thereof extending into the hollow elongated body and functions to apply a constant force on the hollow elongated member to urge the hollow elongated member and therefore the canopy in a direction away from the upper surface of the body portion of the cart. Locking means are provided for holding the canopy at a desired position above the upper surface of the body portion of the cart and comprises a plurality of spaced apart openings extending through each hollow elongated body and a spring urged detent on each hollow elongated member which spring urged detent is adapted to enter into one of the openings in the hollow elongated body to hold the canopy at a desired position above the upper surface of the body portion of the cart.

BRIEF DESCRIPTION OF THE DRAWINGS

Illustrative embodiments, including the presently preferred embodiment, of the invention are shown in the accompanying drawing in which:

FIG. 1 is a perspective view of a movable merchandising cart having a canopy;

FIG. 2 is a top plan view of the frame means for supporting the canopy and the pivot means;

FIG. 3 is a cross-sectional view taken on the line 3—3 of FIG. 2; and

FIG. 4 is a top plan view of a portion of the frame means for supporting the canopy and the pivot means of another embodiment of the invention.

DETAILED DESCRIPTION OF THE INVENTION

In FIG. 1, there is illustrated a movable merchandising cart 2 having a body portion 4 which is supported on a plurality of conventional rollers 6 and has an upper surface 8 having two opposite relatively short linearly extending sides 10 and 12 parallel to each other and two opposite relatively long linearly extending sides 14 and 16 parallel to each other. The upper surface 8 also has four corners 18, 20, 22 and 24. Bracket means 26 are mounted on the upper surface 8 adjacent each of the four corners 18, 20, 22 and 24. Upwardly extending support means 28 are located at each of the corners 18, 20, 22 and 24 and comprise an elongated hollow body 30, illustrated specifically in FIG. 3, having generally cylindrical inner and outer surfaces 32 and 34 mounted in each of the bracket means 26. Each hollow elongated body 30 is provided with a plurality of spaced apart openings 36 extending in a vertical direction for purposes described below.

A canopy 40 is provided for the movable merchandising cart 2 and is mounted on the frame means 42. The frame means 42 comprises two opposite relatively short linearly extending angle members 48 and 50 and two opposite relatively long linearly extending angle members 52 and 54. The angle members 48, 50, 52 and 54 are secured together by suitable means such as by welding. A hollow socket member 56 is mounted at each corner formed by the intersections of the angle members 48 and 50 with the angle members 52 and 54 and arcuately shaped rods 57 extending in a plane generally parallel to the angle members 48 and 50 are mounted therein and function to support the canopy 40. The angle members 48 and 50 are substantially parallel to the relatively short sides 10 and 12, and the angle members 52 and 54 are substantially parallel to the relatively long sides 14 and 16. Two reinforcing angle members 58 and 60 extend in linear directions substantially parallel to the relatively short angle members 48 and 50 and are secured to the relatively long angle members 52 and 54 by suitable means such as by welding. Plate members 62 are secured to the angle members 48 and 58 and to the angle members 50 and 60 adjacent to but spaced from their intersections with the angle members 52 and 54 by suitable means such as by welding. Bracket means 64 comprising a relatively flat base member 66 and socket means 68 are secured to the plate member 62 by nuts and bolts 70 passing through openings in the plate member 62 and the base member 66.

A plurality of downwardly extending support means 72 are provided and comprise a hollow elongated member 74 mounted in each of the socket means 68 and having generally cylindrical inner and outer surfaces 76 and 78. The diameter of the generally cylindrical outer surface 78 is smaller than the diameter of the generally cylindrical inner surface 32 so that the hollow elongated member 74 may be inserted into the hollow elongated body 30 and permit relative sliding movement therebetween. Each hollow elongated member 74 is mounted on a pivot pin 80 passing through aligned openings in the socket means 68 and the hollow elongated member 74 and which pivot pin 80 is secured in the socket means 68 by a head portion 82 and a nut 84 to permit relative pivotal movement between the frame means 42 and the hollow elongated members 74. In the embodiment illustrated in FIGS. 2 and 3, each pivot pin 80 has a longitudinal axis extending generally parallel to the angle members 52 and 54 and the relatively long sides 14 and 16.

Pressure applying means for urging the frame means 42 and therefore the canopy 40 in a direction away from the upper surface 8 are provided and comprise a gas spring 88 having a pressure cylinder 90 having a ring member 92 secured thereto for pivotally mounting the pressure cylinder 90 on the pivot pin 80. A rod 94 is urged outwardly from the pressure cylinder 90 and has the free end 96 thereof located in a recess 98 in a support member 100 which is secured to the upper surface 8 and is located within the hollow elongated body 30. The gas spring 88 functions to provide a constant force on the hollow elongated members 74 to urge the hollow elongated member 74 in a direction away from the upper surface 8 of the body portion 4. Locking means are provided for holding each hollow elongated member 74 at desired positions relative to the hollow elongated body 30 and comprise a pin member 102 resiliently mounted on the inner surface 76 by spring means 104 which urges the pin member 102 outwardly through an opening 106 and, when aligned with one of the openings 36, outwardly through such aligned opening to hold the elongated hollow member 74 and the hollow elongated body 30 in a relatively fixed relationship.

In FIG. 4, there is disclosed a pivotal mounting of each of the hollow elongated members 74 wherein the longitudinal axis of each pivot pin 80 extends in a direction substantially parallel to the angle members 48 and 50 and the relatively short sides 10 and 12. In this modification, the reinforcing angle members 58 and 60 extend in linear directions substantially parallel to the relatively long angle members 52 and 54 and are secured to the relatively short angle members 48 and 50. The plate members 66 are secured to the angle members 52 and 58 and to the angle members 54 and 60 by suitable means such as by welding.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A movable cart for merchandising products comprising:

a movable cart having a body portion having an upper surface having at least four corner locations;

upwardly extending support means secured to said upper surface at areas next adjacent to said at least four corner locations;

canopy means for said cart located at a distance spaced above said body portion;

frame means for supporting said canopy and having at least four corners;

mounting means for mounting said canopy on said frame means;

downwardly extending support means connected to said frame means at areas next adjacent to said at least four corners;

said downwardly extending support means being mounted within said upwardly extending support means to permit relative sliding movement therebetween;

locking means between said upwardly extending support means and said downwardly extending support means to hold said upwardly extending support means and said downwardly extending support means in a relatively fixed relationship; and pivot means for pivotally connecting each of said downwardly extending support means to said frame means.

2. The invention as in claim 1 and further comprising:

force applying means for applying forces to said downwardly extending support means to urge said downwardly extending support means and said frame means in an upward direction away from said upper surface.

3. The invention as in claim 2 wherein:

each of said upwardly extending support means comprises a hollow elongated body having an inner cross-sectional configuration;

each of said downwardly extending support means comprises a hollow elongated member having an outer cross-sectional configuration to mate with said inner cross-sectional configuration of said hollow elongated body; and said outer cross-sectional configuration being slightly smaller than said inner cross-sectional configuration so that said hollow elongated member can be inserted into said hollow elongated body and provide said relative sliding movement therebetween.

4. The invention as in claim 3 wherein:

said inner cross-sectional configuration is circular; and said outer cross-sectional configuration is circular.

5. The invention as in claim 3 wherein:

said force applying means are located in said hollow elongated body and said hollow elongated member.

6. The invention as in claim 5 wherein said force applying means comprises:

a gas spring.

7. The invention as in claim 6 wherein:

said hollow elongated body has a cylindrical outer surface and a cylindrical inner surface;

said hollow elongated member has a cylindrical outer surface; and said cylindrical outer surface of said hollow elongated member having a diameter slightly smaller than the diameter of said inner surface of said hollow elongated body so that said hollow elongated member may be inserted into said hollow elongated body and provide said relative sliding movement therebetween.

8. The invention as in claim 7 wherein said locking means comprises:

a plurality of vertically spaced apart aligned openings extending through said hollow elongated body from said outer cylindrical surface to said inner cylindrical surface;

an opening extending through said hollow elongated member; and detent means mounted on said hollow elongated member and located to extend through said opening in said hollow elongated member and one of said openings in said hollow elongated body.

9. The invention as in claim 8 and further comprising:

said hollow elongated body has a cylindrical outer surface and a cylindrical inner surface;

said hollow elongated member has a cylindrical outer surface; and said cylindrical outer surface of said hollow elongated member having a diameter slightly smaller than the diameter of said inner surface of said hollow elongated body so that said hollow elongated member may be inserted into said hollow elongated body and provide said relative sliding movement therebetween.

17. The invention as in claim 16 wherein said locking means comprises:

a plurality of vertically spaced apart aligned openings extending through said hollow elongated body from said outer cylindrical surface to said inner